US010675216B2

(12) United States Patent
Mejia

(10) Patent No.: US 10,675,216 B2
(45) Date of Patent: Jun. 9, 2020

(54) MEDICINE CONTAINER CLOSURE DEVICE

(71) Applicant: Gilberto Mejia, Canyon Country, CA (US)

(72) Inventor: Gilberto Mejia, Canyon Country, CA (US)

( * ) Notice: Subject to any disclaimer, the term of this patent is extended or adjusted under 35 U.S.C. 154(b) by 0 days.

(21) Appl. No.: 15/800,906

(22) Filed: Nov. 1, 2017

(65) Prior Publication Data

US 2019/0125626 A1 May 2, 2019

(51) Int. Cl.

| | |
|---|---|
| ***A61J 1/03*** | (2006.01) |
| ***A61J 7/04*** | (2006.01) |
| ***B65D 51/00*** | (2006.01) |
| ***A61J 1/14*** | (2006.01) |
| *B65D 41/04* | (2006.01) |

(52) U.S. Cl.

CPC ..... *A61J 1/03* (2013.01); *A61J 1/1418* (2015.05); *A61J 7/04* (2013.01); *A61J 7/0418* (2015.05); *B65D 51/002* (2013.01); *B65D 41/0471* (2013.01)

(58) Field of Classification Search

CPC ..... A61J 1/03; A61J 1/1412; A61J 2205/70; B65B 7/28; B65D 41/0471; B65D 43/163; B65D 51/248; G04G 9/00

See application file for complete search history.

(56) References Cited

U.S. PATENT DOCUMENTS

| | | | | |
|---|---|---|---|---|
| 4,572,403 | A * | 2/1986 | Benaroya | A61J 7/04 221/15 |
| 4,847,597 | A | 7/1989 | Dobosi et al. | |
| 5,351,818 | A * | 10/1994 | Daneshvar | A61J 1/03 206/216 |
| 6,317,390 | B1 * | 11/2001 | Cardoza | A61J 7/0481 221/2 |
| 6,545,592 | B2 | 4/2003 | Weiner | |
| D525,538 | S | 7/2006 | Oas | |
| 7,081,807 | B2 | 7/2006 | Lai | |
| 8,666,543 | B2 * | 3/2014 | MacVittie | B65D 83/0409 221/241 |
| 8,823,510 | B2 | 9/2014 | Downey et al. | |
| 9,345,645 | B1 * | 5/2016 | Chernyak | A61J 7/0418 |
| 9,361,780 | B2 * | 6/2016 | Burke, Jr. | G08B 21/24 |
| 9,710,608 | B2 * | 7/2017 | Mikhail | A61J 1/1425 |
| 9,918,905 | B1 * | 3/2018 | Howard | A61J 1/1412 |
| 2003/0099158 | A1 * | 5/2003 | De la Huerga | A61J 7/0084 368/10 |
| 2009/0294521 | A1 * | 12/2009 | de la Huerga | A61J 1/035 235/375 |
| 2010/0142330 | A1 * | 6/2010 | Reygaert | A61J 7/0481 368/10 |

(Continued)

*Primary Examiner* — Gene O Crawford
*Assistant Examiner* — Kelvin L Randall, Jr.

(57) ABSTRACT

A medicine container closure device for recording and broadcasting information about the contents of a container includes a housing that defines an interior space. The housing is configured to couple to a bottle to selectively close the bottle. A power module and a recording-playback assembly are coupled to the housing and are positioned in the interior space. The recording-playback assembly is operationally coupled to the power module. The recording-playback assembly is configured to record and broadcast information regarding the contents of the bottle, such as a name, a usage, a purpose, and a date to refill the contents.

1 Claim, 3 Drawing Sheets

(56) References Cited

U.S. PATENT DOCUMENTS

| | | | | |
|---|---|---|---|---|
| 2011/0297691 | A1* | 12/2011 | Freeman | B23C 3/35 221/8 |
| 2014/0130453 | A1* | 5/2014 | Shalala | B65B 7/28 53/420 |
| 2014/0214200 | A1* | 7/2014 | Chrusciel | G06F 19/3462 700/237 |
| 2015/0360834 | A1* | 12/2015 | Mikhail | A61J 1/1425 340/384.5 |
| 2016/0048657 | A1* | 2/2016 | LeBrun | G06F 19/3462 705/2 |
| 2018/0263854 | A1* | 9/2018 | Taylor | A61J 7/0436 |

* cited by examiner

MEDICINE CONTAINER CLOSURE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to container closure devices and more particularly pertains to a new container closure device for recording and broadcasting information about the contents of a container.

BRIEF SUMMARY OF THE INVENTION

An embodiment of the disclosure meets the needs presented above by generally comprising a housing that defines an interior space. The housing is configured to couple to a bottle to selectively close the bottle. A power module and a recording-playback assembly are coupled to the housing and are positioned in the interior space. The recording-playback assembly is operationally coupled to the power module. The recording-playback assembly is configured to record and broadcast information regarding contents of the bottle, such as a name, a usage, a purpose, and a date to refill the contents.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
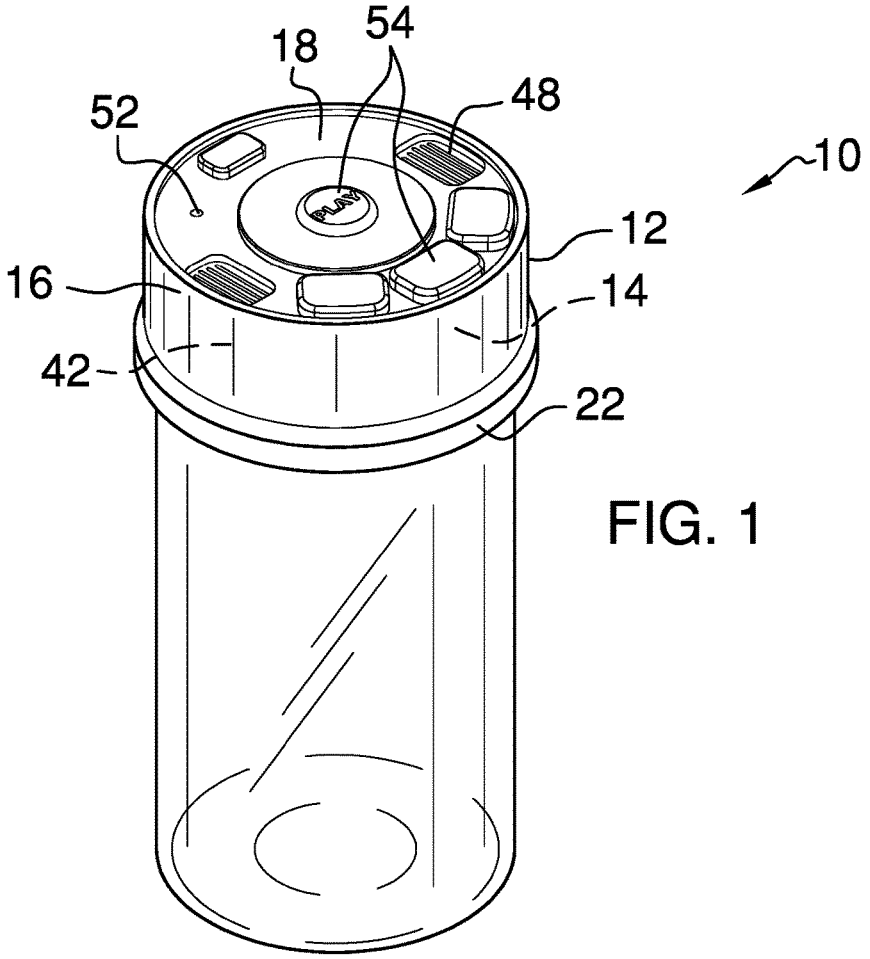
FIG. 1 is an isometric perspective view of a medicine container closure device according to an embodiment of the disclosure.
Figure 2:
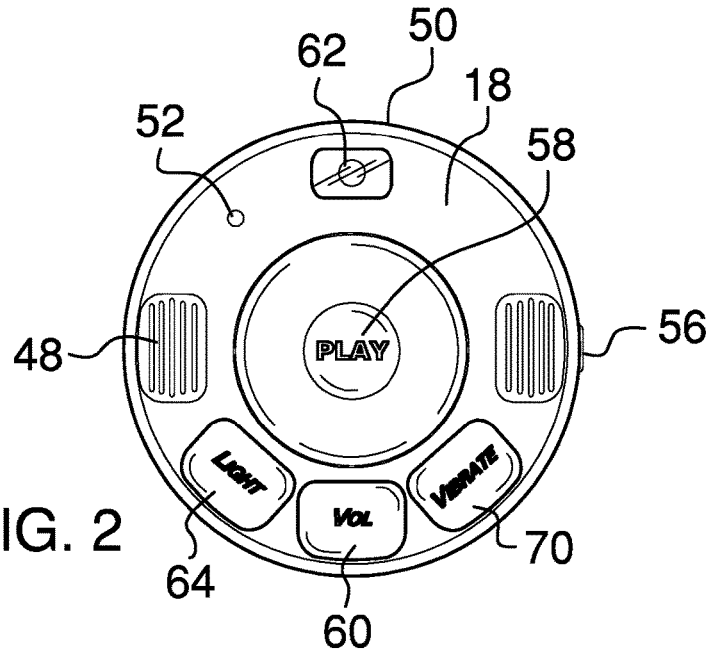
FIG. 2 is a top view of an embodiment of the disclosure.
Figure 3:
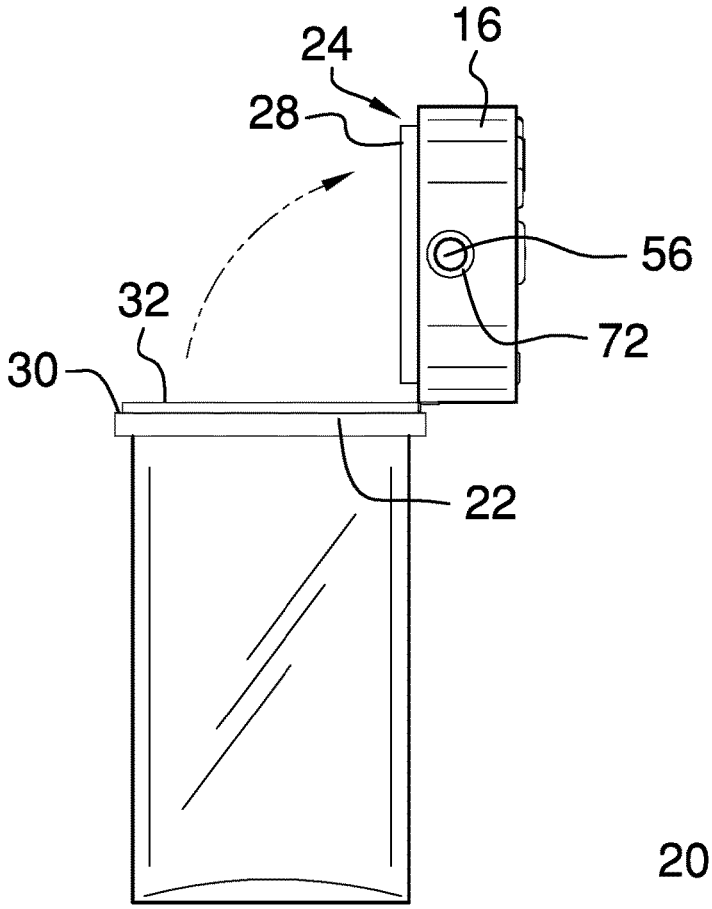
FIG. 3 is a side view of an embodiment of the disclosure.
Figure 4:
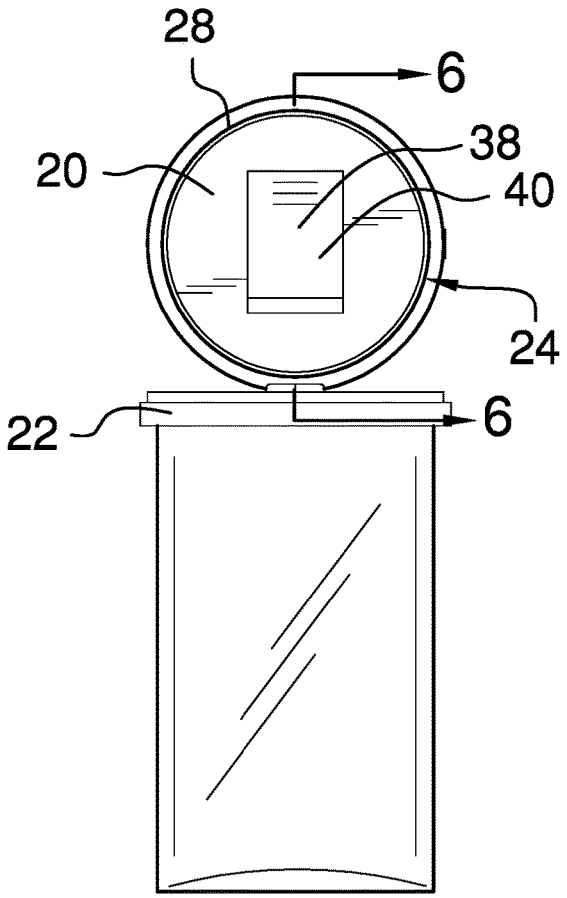
FIG. 4 is a bottom view of an embodiment of the disclosure.
Figure 5:
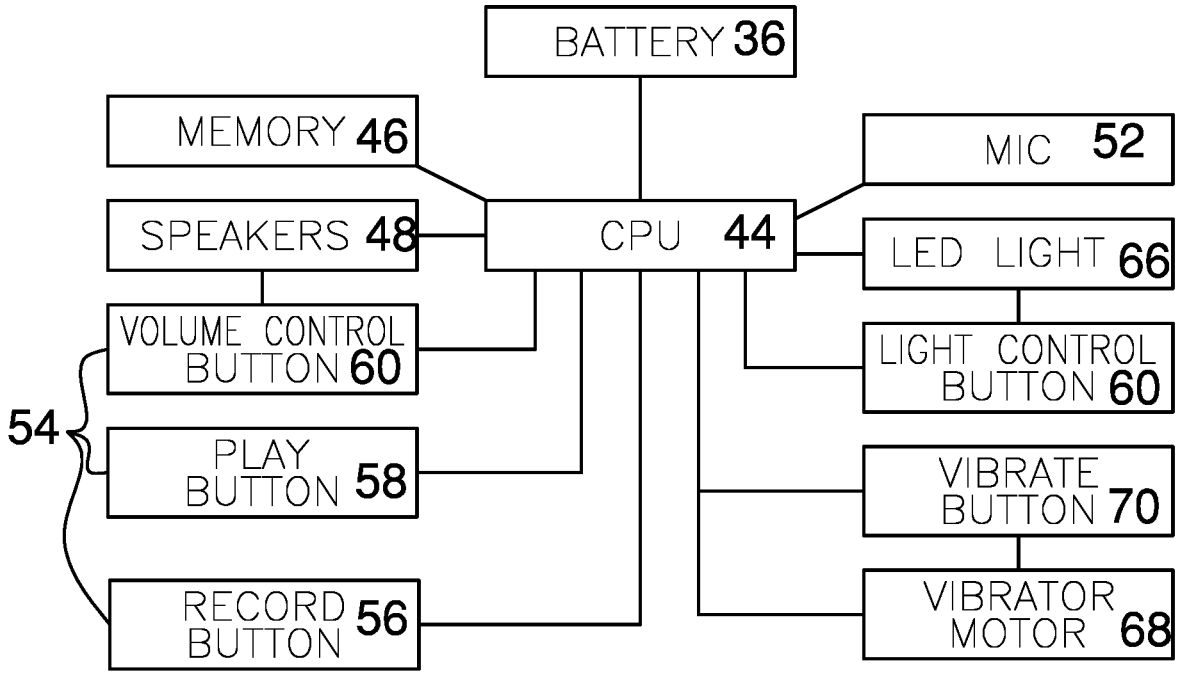
FIG. 5 is a block diagram of an embodiment of the disclosure.
Figure 6:
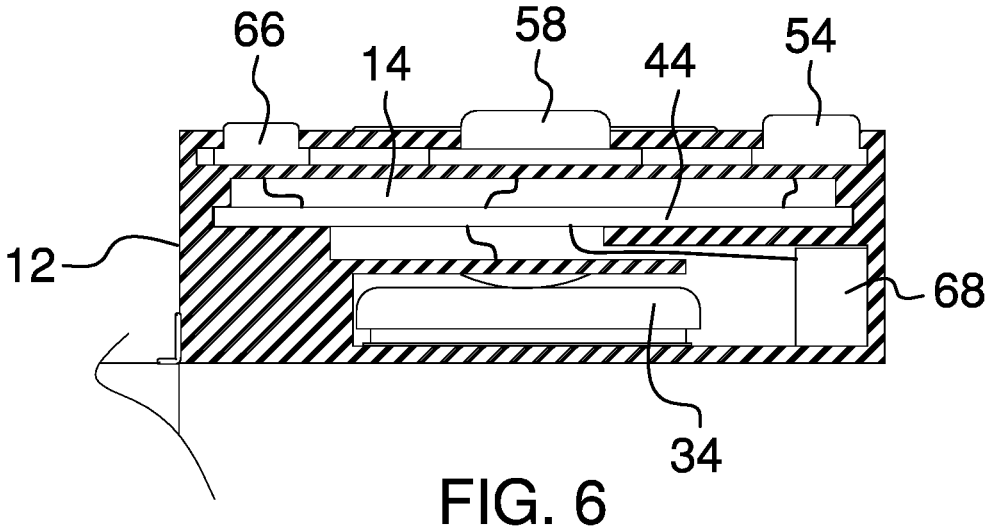
FIG. 6 is a cross-sectional view of an embodiment of the disclosure.

With reference now to the drawings, and in particular to FIGS. 1 through 6 thereof, a new container closure device embodying the principles and concepts of an embodiment of the disclosure and generally designated by the reference numeral 10 will be described.

As best illustrated in FIGS. 1 through 6, the medicine container closure device 10 generally comprises a housing 12 that defines an interior space 14. The housing 12 is configured to couple to a bottle to selectively close the bottle. The housing 12 comprises an annular wall 16 that extends between a top 18 and a bottom 20. In one embodiment, the top 18 and the bottom 20 are circularly shaped.

A ring 22 is hingedly coupled to the bottom 20 of the housing 12. The ring 22 is threaded. The ring 22 is configured to threadedly couple to the bottle to couple the housing 12 to the bottle.

A first inset 24 is positioned in a lower perimeter 26 of the housing 12. A lip 28 is coupled to and extends from the housing 12. The lip 28 is positioned adjacent to the first inset 24. A second inset 30 is positioned in an upper circumference 32 of the ring 22. The ring 22 is positioned to insert the housing 12 so that the lip 28 is positioned on the second inset 30 and the housing 12 selectively closes the bottle.

A power module 34 is coupled to the housing 12 and is positioned in the interior space 14. In one embodiment, the power module 34 comprises at least one battery 36.

An opening 38 is positioned in the bottom 20 of the housing 12 proximate to the power module 34. A panel 40 is selectively couplable to the bottom 20 of the housing 12 to selectively close the opening 38. The panel 40 is configured to decouple from the housing 12 so that the opening 38 is configured to access the power module 34.

A recording-playback assembly 42 is coupled to the housing 12 and is positioned in the interior space 14. The recording-playback assembly 42 is operationally coupled to the power module 34. The recording-playback assembly 42 is configured to record and broadcast information regarding contents of the bottle, such as a name, a usage, a purpose, and a date to refill the contents.

The recording-playback assembly 42 comprises a microprocessor 44 that is coupled to the housing 12 and positioned in the interior space 14. The microprocessor 44 is operationally coupled to the power module 34. A data storage module 46 is coupled to the housing 12 and positioned in the interior space 14. The data storage module 46 is operationally coupled to the microprocessor 44. The microprocessor 44 is positioned to compel the data storage module 46 to store the information.

A plurality of speakers 48 is coupled to the housing 12. The speakers 48 are operationally coupled to the microprocessor 44. The microprocessor 44 is positioned to compel the speakers 48 to broadcast the information. In one embodiment, the plurality of speakers 48 comprises two speakers 48 that are diametrically opposingly positioned on the top 18 of the housing 12 proximate to an upper perimeter 50 of the housing 12.

A microphone 52 is coupled to the top 18 of the housing 12. The microphone 52 is operationally coupled to the microprocessor 44. The microphone 52 is configured to receive the information and to relay the information to the microprocessor 44.

A controller 54 is coupled to the housing 12. The controller 54 is operationally coupled to the microprocessor 44. The controller 54 is configured to input commands into the microprocessor 44, such as commands to receive the information from the microphone 52, to compel the data storage module 46 to store the information, to compel the speakers 48 to broadcast the information, and to set a volume level of the speakers 48.

In one embodiment, the controller 54 comprises a first button 56, a second button 58, and a third button 60. The first button 56 is positioned in a recess 72 that is positioned in the annular wall 16. The first button 56 is configured to be depressed to compel the microprocessor 44 to receive the information from the microphone 52 and to compel the data storage module 46 to store the information. The second button 58 is centrally positioned on the top 18 of the housing 12. The second button 58 is configured to be depressed to compel the microprocessor 44 to compel the speakers 48 to broadcast the information. The third button 60 is positioned on the top 18 of the housing 12 proximate to the upper perimeter 50 of the housing 12. The third button 60 is configured to be depressed to compel the microprocessor 44 to set the volume level of the speakers 48.

At least one bulb 62 is coupled to the top 18 of the housing 12. The at least one bulb 62 is operationally coupled to the microprocessor 44. A fourth button 64 is positioned on the top 18 of the housing 12 proximate to the upper perimeter 50 of the housing 12. The fourth button 64 is operationally coupled to the microprocessor 44. The fourth button 64 is configured to be depressed to compel the microprocessor 44 to illuminate the at least one bulb 62 at a respective time. In one embodiment, the at least one bulb 62 comprises at least one light emitting diode 66.

A motor 68 is coupled to the housing 12 and is positioned in the interior space 14. The motor 68 is configured to vibrate the housing 12. A fifth button 70 is positioned on the top 18 of the housing 12 proximate to the upper perimeter 50 of the housing 12. The fifth button 70 is operationally coupled to the microprocessor 44. The fifth button 70 is configured to be depressed to compel the microprocessor 44 to vibrate the housing 12 at the respective time.

In use, the ring 22 is configured to threadedly couple to the bottle to couple the housing 12 to the bottle. The first inset 24 is positioned in the housing 12 so that the ring 22 is positioned to insert the housing 12. The lip 28 is positioned on the second inset 30 and the housing 12 selectively closes the bottle. The first button 56 is configured to be depressed to compel the microprocessor 44 to receive the information regarding the contents of the bottle, such as the name, the usage, the purpose, and the date to refill the contents, from the microphone 52 and to compel the data storage module 46 to store the information. The second button 58 is configured to be depressed to compel the microprocessor 44 to compel the speakers 48 to broadcast the information. The third button 60 is configured to be depressed to compel the microprocessor 44 to set the volume level of the speakers 48. The fourth button 64 is configured to be depressed to compel the microprocessor 44 to illuminate the at least one bulb 62 at the respective time. The fifth button 70 is configured to be depressed to compel the microprocessor 44 to vibrate the housing 12 at the respective time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A medicine container closure device comprising:

a housing defining an interior space, said housing being configured for coupling to a bottle for selectively closing the bottle, said housing comprising an annular wall extending between a top and a bottom, said top and said bottom being circularly shaped;

a ring hingedly coupled to said bottom of said housing, said ring being threaded such that said ring is configured for threadedly coupling to the bottle for coupling said housing to the bottle;

a first inset positioned in a lower perimeter of said housing said first inset defining a lip positioned at a bottom of said housing;

a second inset positioned in an upper circumference of said ring, wherein said first inset is positioned in said housing such that said ring is positioned for inserting said housing such that said lip is positioned on said second inset and wherein said housing selectively closes the bottle;

a power module coupled to said housing and positioned in said interior space, said power module comprising at least one battery;

an opening positioned in said bottom of said housing proximate to said power module;

a panel selectively couplable to said bottom of said housing for selectively closing said opening, wherein said panel is positioned on said housing such that said panel is configured for decoupling from said housing such that said opening is configured for accessing said power module;

a recording-playback assembly coupled to said housing and positioned in said interior space, said recording-playback assembly being operationally coupled to said power module, wherein said recording-playback assembly is positioned in said housing such that said recording-playback assembly is configured for recording and broadcasting information regarding contents of the bottle, said recording-playback assembly comprising:

a microprocessor coupled to said housing and positioned in said interior space, said microprocessor being operationally coupled to said power module, a data storage module coupled to said housing and positioned in said interior space, said data storage module being operationally coupled to said microprocessor, wherein said data storage module is positioned in said housing such that said microprocessor is positioned for compelling said data storage module for storing the information, a plurality of speakers coupled to said housing, said speakers being operationally coupled to said microprocessor, wherein said speakers are positioned on said housing such that said microprocessor is positioned for compelling said speakers for broadcasting the information, said plurality of speakers comprising two said speakers diametrically opposingly positioned on said top of said housing proximate to an upper perimeter of said housing, a microphone coupled to said top of said housing, said microphone being operationally coupled to said microprocessor, wherein said microphone is positioned on said housing such that said microphone is configured for receiving the information and for relaying the information to said microprocessor, and a controller coupled to said housing, said controller being operationally coupled to said microprocessor, said controller being configured for inputting commands into said microprocessor for compelling said data storage module for storing the information, for compelling said speakers for broadcasting the information, and for setting a volume level of said speakers, wherein said controller is positioned on said housing such that said controller is configured for inputting the commands into said microprocessor for compelling said data storage module for storing the information, for compelling said speakers for broadcasting the information, and for setting the volume level of said speakers, said controller comprising a first button, a second button, and a third button, said first button being positioned in a recess positioned in said annular wall, wherein said first button is positioned in said recess such that said first button is configured for depressing for compelling said microprocessor for receiving the information from said microphone and for compelling said data storage module for storing the information, said second button being centrally positioned on said top of said housing, wherein said second button is positioned on said housing such that said second button is configured for depressing for compelling said microprocessor for compelling said speakers for broadcasting the information, said third button being positioned on said top of said housing proximate to said upper perimeter of said housing, wherein said third button is positioned on said housing such that said third button is configured for depressing for compelling said microprocessor for setting the volume level of said speakers;

at least one bulb coupled to said top of said housing, said at least one bulb being operationally coupled to said microprocessor, said at least one bulb comprising at least one light emitting diode;

a fourth button positioned on said top of said housing proximate to said upper perimeter of said housing, said fourth button being operationally coupled to said microprocessor, wherein said fourth button is positioned on said housing such that said fourth button is configured for depressing for compelling said microprocessor for illuminating said at least one bulb at a respective time;

a motor coupled to said housing and positioned in said interior space, said motor being configured for vibrating said housing;

a fifth button positioned on said top of said housing proximate to said upper perimeter of said housing, said fifth button being operationally coupled to said microprocessor, wherein said fifth button is positioned on said housing such that said fifth button is configured for depressing for compelling said microprocessor for vibrating said housing at the respective time; and wherein said ring is configured for threadedly coupling to the bottle for coupling said housing to the bottle, wherein said first inset is positioned in said housing such that said ring is positioned for inserting said housing such that said lip is positioned on said second inset and wherein said housing selectively closes the bottle, wherein said first button is positioned in said recess such that said first button is configured for depressing for compelling said microprocessor for receiving the information regarding the contents of the bottle from said microphone and for compelling said data storage module for storing the information, wherein said second button is positioned on said housing such that said second button is configured for depressing for compelling said microprocessor for compelling said speakers for broadcasting the information, wherein said third button is positioned on said housing such that said third button is configured for depressing for compelling said microprocessor for setting the volume level of said speakers, wherein said fourth button is positioned on said housing such that said fourth button is configured for depressing for compelling said microprocessor for illuminating said at least one bulb at the respective time, wherein said fifth button is positioned on said housing such that said fifth button is configured for depressing for compelling said microprocessor for vibrating said housing at the respective time.

* * * * *